US006940502B2

(12) United States Patent
Lin et al.

(10) Patent No.: US 6,940,502 B2
(45) Date of Patent: Sep. 6, 2005

(54) FLAT PANEL DISPLAY DEVICE WITH REDUCED RIPPLE INTERFERENCE RESULTING FROM GROUND CURRENT

(75) Inventors: Wei-Hong Lin, Hsin-Chu (TW); Chin-Der Wey, Hsin-Chu (TW); Teng-Ho Wu, Hsin-Chu (TW)

(73) Assignee: Ambit Microsystems Corp., Hsin-Chu (TW)

( * ) Notice: Subject to any disclaimer, the term of this patent is extended or adjusted under 35 U.S.C. 154(b) by 298 days.

(21) Appl. No.: 10/249,890

(22) Filed: May 15, 2003

(65) Prior Publication Data

US 2004/0046723 A1 Mar. 11, 2004

(30) Foreign Application Priority Data

Sep. 20, 2002 (TW) ..... 91121692 A

(51) Int. Cl.[7] ..... G09G 5/00

(52) U.S. Cl. ..... 345/211; 345/212; 345/905

(58) Field of Search ..... 345/905, 211–212; 348/794, 836; 361/681

(56) References Cited

U.S. PATENT DOCUMENTS 6,624,503 B1 * 9/2003 Madsen et al. ..... 257/659

* cited by examiner

*Primary Examiner*—Richard Hjerpe
*Assistant Examiner*—Rodney Amadiz
(74) *Attorney, Agent, or Firm*—Winston Hsu

(57) ABSTRACT

A liquid crystal display (LCD) device has a housing acting as a conductor, a plurality of circuits, and at least a filter unit. Each circuit has a reference voltage terminal electrically connected to a reference voltage level. When the reference voltage terminal of each circuit is electrically connected to the housing, one filter unit is electrically connected between the housing and a ground terminal. When the housing is electrically connected to the ground terminal, a plurality of filter units are respectively connected between the housing and the reference voltage terminal of each circuit.

18 Claims, 13 Drawing Sheets

FLAT PANEL DISPLAY DEVICE WITH REDUCED RIPPLE INTERFERENCE RESULTING FROM GROUND CURRENT

BACKGROUND OF INVENTION

1. Field of the Invention

The present invention relates to a flat panel display device, more specifically to a flat panel display device capable of reducing the ripple interference resulting from ground current.

2. Description of the Prior Art

A flat panel display device, especially a liquid crystal display (LCD), due to its low power dissipation, low radiation, and smaller volume than a traditional cathode ray tube (CRT) display, is widely used in notebook PCs, personal digital assistants (PDAs), cellular phones, clocks, etc, and even there is an increasing tendency to substitute the CRT monitor by a LCD for a desktop PC.

Please refer to FIG. 1, which shows a schematic diagram of a LCD device 10 according to prior art. The LCD device 10 includes a housing 12 and a plurality of circuits 14 such as an AC/DC adapter 14*a* for transforming and rectifying an AC voltage $V_{AC}$ into a DC voltage, a DC/AC inverter 14*b* for transforming a DC voltage into an AC voltage with a high frequency and a high voltage value for driving a discharge tube of a backlight module in the LCD device 10, a DC/DC converter 14*c* for transforming the DC voltage into a required operating voltage, a controller 14*d* for controlling the LCD panel of the LCD device 10, and other system circuits (not shown). Each circuit 14 includes a reference voltage end electrically connected with a reference voltage level. For example, a node B is the reference voltage end of the DC/AC adapter 14*b*. Because the housing 12 is a conductor electrically connected to a ground terminal Gnd, as shown in FIG. 1, the reference voltage end of each circuit 14 is connected to the housing 12. In other words, the reference voltage end of each circuit 14 is connected to the ground terminal Gnd so as to connect to a ground level in a normal operation. Moreover, a display driver 18 of a host 16, which is used to transmit data to the controller 14*d*, is connected to the controller 14*d* and thus the controller 14*d* will drive the LCD device 10 according to the data to be displayed so that the data to be displayed is displayed on the LCD panel.

Please refer to FIG. 2 and FIG. 3. FIG. 2 and FIG. 3 are schematic diagrams illustrating the status of a conventional LCD device operating under a burst dimming mode, where FIG. 2 shows a status of a conventional LCD device operating under a full-load current condition and FIG. 3 shows a status of a conventional LCD device operating under a half-load current condition. As far as the conventional display device is considered, a user can adjust a brightness of the display device based on his demand. However, the variation in brightness of the LCD device will become uniform under the burst mode dimming operation, in which pixels at different positions will generate identical variations in brightness during the brightness adjusting process. A principle of the burst mode dimming operation is summarized as follows. Assume that the controller 14*d* drives the LCD device 10 based on a current Ia, where the current Ia is defined as the brightness of the LCD device 10 (that is, 0–255 gray levels). In order to keep the gray level of the LCD device to be correspondent with the current Ia, the controller 14*d* will continuingly drive the LCD device 10 based on the current Ia, a shown in FIG. 2. However, when a user intends to adjust the brightness of the LCD device 10, for example when a user intends to reduce the original brightness of the LCD device 10 by half, the controller 14*d* still drives the LCD device 10 based on the current launder the burst dimming mode, but the duration for driving the controller 14*d* will be changed. As shown in FIG. 3, the controller 14*d* drives the LCD device 10 for only 1/400 second in every 1/200 second time period. That is, the current 1*a* can be considered as working at a frequency of 200 Hz with a duty cycle being tantamount to 50%. This means the controller 14*d* defines the brightness of the LCD device 10 as an equivalent to the current value of (½*Ia), so that the brightness setting of the LCD device 10 can be reduced. In this way, under bust dimming mode the current value Ia at a predetermined frequency (for example, 200 Hz) can be equivalently changed by adjusting its duty cycle so as to achieve brightness adjustment under burst dimming mode.

FIG. 4 is an equivalent circuit diagram of FIG. 1 showing the ground terminal Gnd being connected to a ground level. Ground can be regarded as an equivalent circuit constructed from a current source Ig connected in parallel with an inductor Lg. When the LCD device 10 is undergoing brightness adjustment under the burst dimming mode, because the housing 12 is connected to the ground terminal Gnd, a low-frequency ripple current Ig will be induced at the ground terminal Gnd to flow into the LCD device 10. The current Ig will influence a duty cycle of the current Ia, resulting in a corresponding fluctuation on the equivalent current Ia. The fluctuation of the brightness of a LCD device causes an output ripple wave on the display panel, leading to a bad display quality due to the ripple interference.

SUMMARY OF INVENTION

It is therefore a primary objective of the claimed invention to provide a flat panel display device with a filter unit between a ground terminal and a housing of the flat panel display device for reducing or filtering a ground current inputted from a ground terminal so as to obviate the ripple interference resulting from the ground current under a burst dimming mode.

Briefly summarized, the claimed invention provides a flat panel display device which includes a housing, a plurality of circuits for driving the flat panel display device, and a filter unit. Each circuit includes an operating voltage level and a reference voltage end electrically connected to a reference voltage level, the reference voltage end of each circuit is connected to the housing. The filter unit is electrically connected between a ground terminal and the housing for reducing or filtering a ground current from the ground terminal.

The claimed invention further provides a flat panel display device including a housing acting as a conductor, a plurality of circuits for driving the flat panel display device, and a plurality of filter units. Each circuit includes a reference voltage end electrically connected to a reference voltage level. Each filter unit is electrically connected between a ground terminal and the housing for reducing or filtering a ground current from the ground terminal.

These and other objectives of the claimed invention will no doubt become obvious to those of ordinary skill in the art after reading the following detailed description of the invention, which is illustrated in the various figures and drawings.

DETAILED DESCRIPTION

Figure 1:
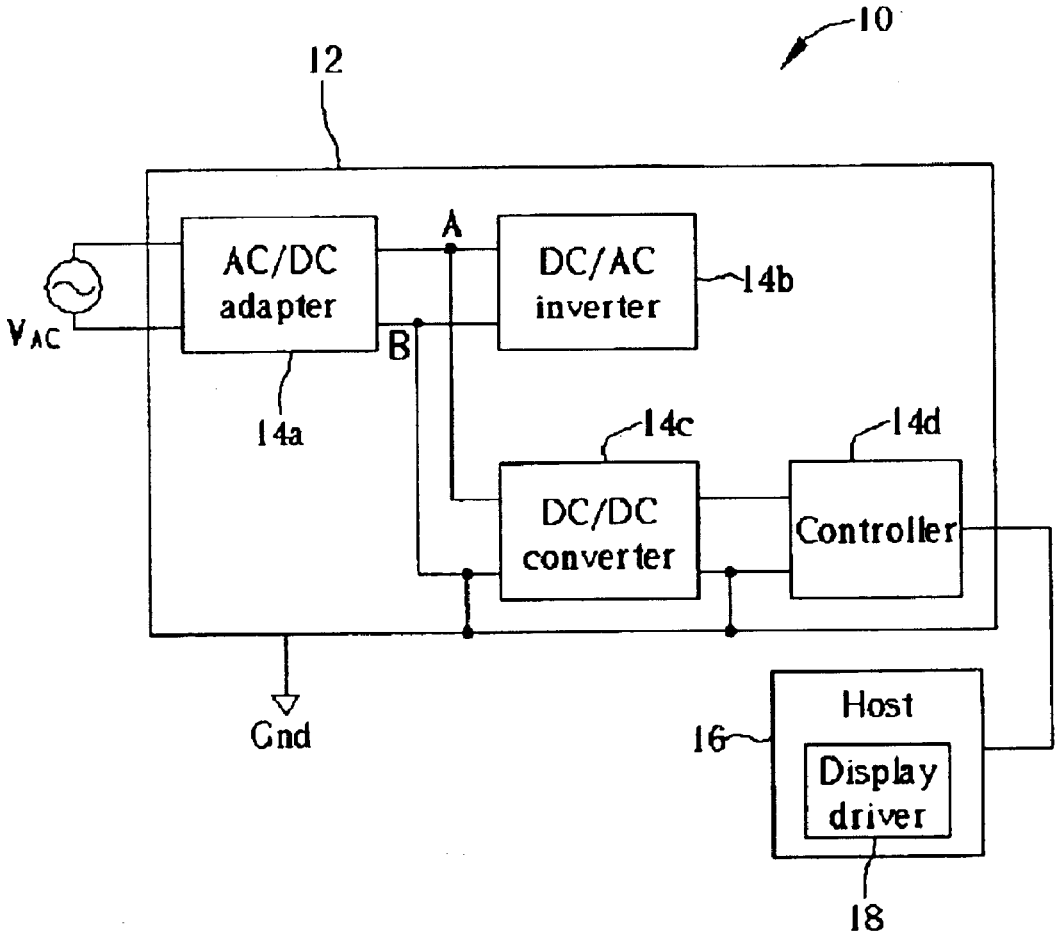
Fig. 1 Prior art
FIG. 1 is a schematic diagram of a LCD device according to prior art.
Figure 2:
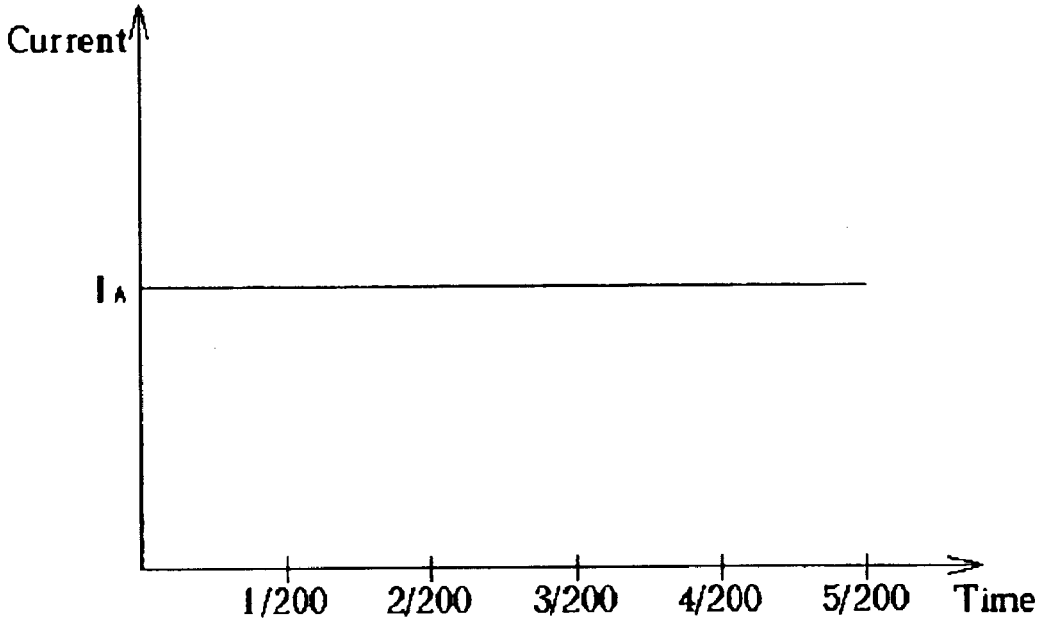
Fig. 2 Prior art
FIG. 2 and FIG. 3 are schematic diagrams illustrating the status of a conventional LCD operating under a burst dimming mode.
Figure 3:
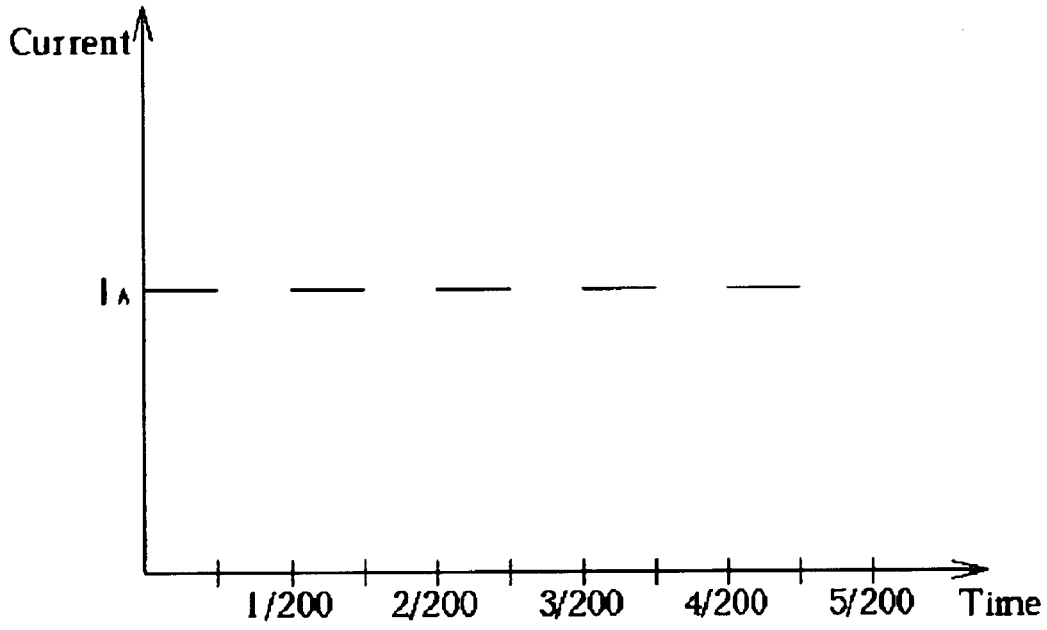
Fig. 3 Prior art
Figure 5:
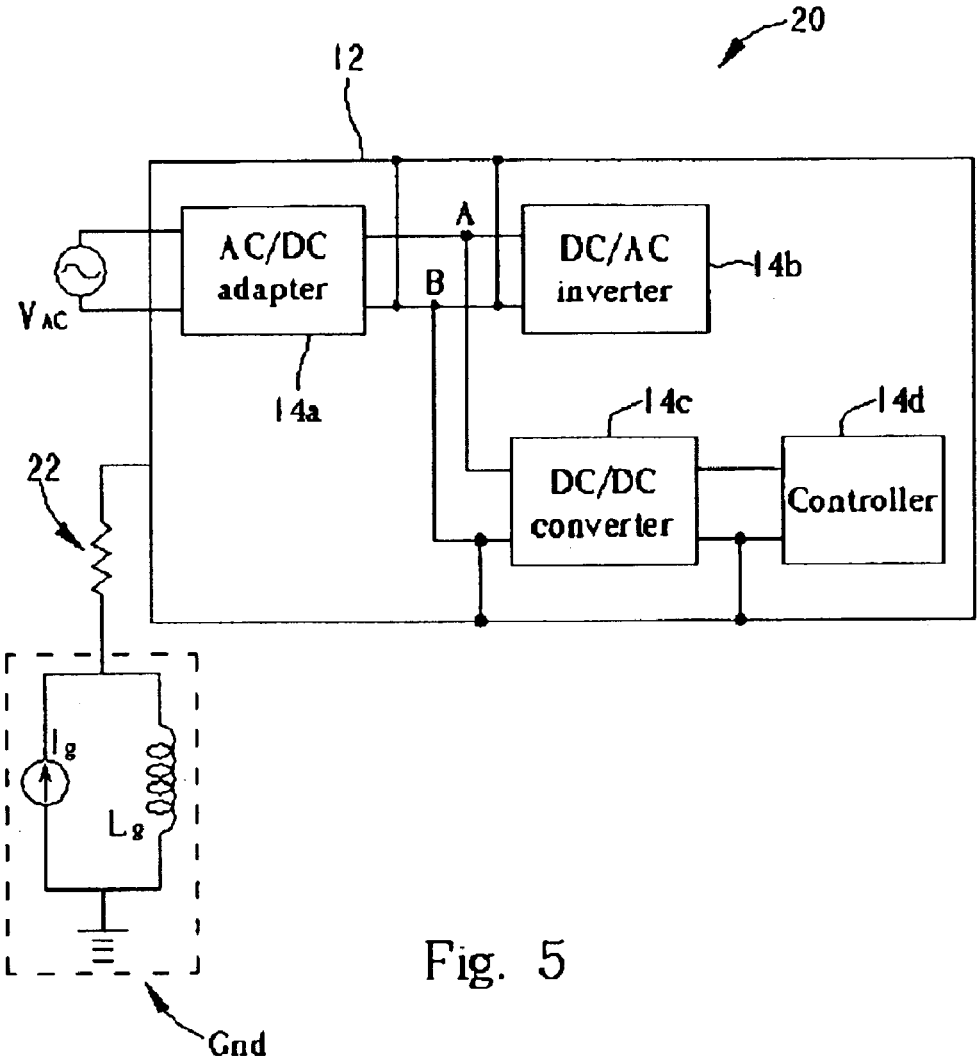
FIG. 5 is the first embodiment of an LCD device according to the present invention.

Please refer to FIG. 1 and FIG. 5, where FIG. 5 is the first embodiment of the LCD device according to the present invention. A LCD device 20 shown in FIG. 5 is similar to the conventional LCD device 10 shown in FIG. 1. The LCD device 20 includes a housing 12 and a plurality of circuits 14 such as an AC/DC adapter 14*a* for transforming and rectifying an AC voltage $V_{AC}$ into a DC voltage, a DC/AC inverter 14*b* for transforming a DC voltage into an AC voltage with a high frequency and a high voltage value for driving a discharge tube of a backlight module in the LCD device 20, a DC/DC converter 14*c* for transforming the DC voltage into a required operating voltage, a controller 14*d* for controlling the LCD panel of the LCD device 20, and other system circuits (not shown). The circuit 14 can be any circuit device of the LCD device 20, however, only a portion of the circuit devices of the LCD device 20 are shown in the present embodiment for simplicity. Each circuit 14 includes a reference voltage end electrically connected with a reference voltage level. For example, a node B is the reference voltage end of the DC/AC adapter 14*b*. In this embodiment, the LCD device 20 includes a filter unit composed of a resistor 22, which is connected between a ground terminal Gnd and the housing 12. Since the housing 12 is used as a conductor, the housing 12 is electrically connected to the resistor 22, and the reference voltage end of each circuit 14 is electrically connected to the housing 12. That is, the reference voltage end of each circuit 14 is electrically connected to the resistor 22. As shown in FIG. 5, an equivalent circuit electrically connected to a ground terminal Gnd is constructed from a current source Ig connected in parallel with an inductor Lg. When the resistor 22 is connected to the equivalent circuit of the ground terminal Gnd, a relation among an impedance Z of the equivalent, the resistor 22 and the inductor Lg can be represented by the following equation of $1/Z=1/R+1/j\omega L$ (where R represents a resistance of the resistor 22, L represents an inductance of the inductor Lg, and $\omega$ is an angular frequency of the current Ig flowing through the inductor Lg). While the current Ig corresponds to a low frequency signal, an impedance associated with the inductor Lg is much smaller than that associated with the resistor 22 so that most of the ground current Ig will flow into the inductor Lg. That is, less current flows into the resistor 22. On the contrary, while the current Ig corresponds to a high frequency signal, an impedance associated with the inductor Lg is much larger than that associated with the resistor 22 so that most of the ground current Ig will flow into the resistor 22. That is, less current flows into to the inductor Lg. In this way, the resistor 22 together with the ground terminal Gnd can be regarded as a high-pass filter (HPF) for reducing a low frequency current with a specific frequency flowing from the ground terminal Gnd to the LCD device 20 under the burst dimming mode.

Figure 6:
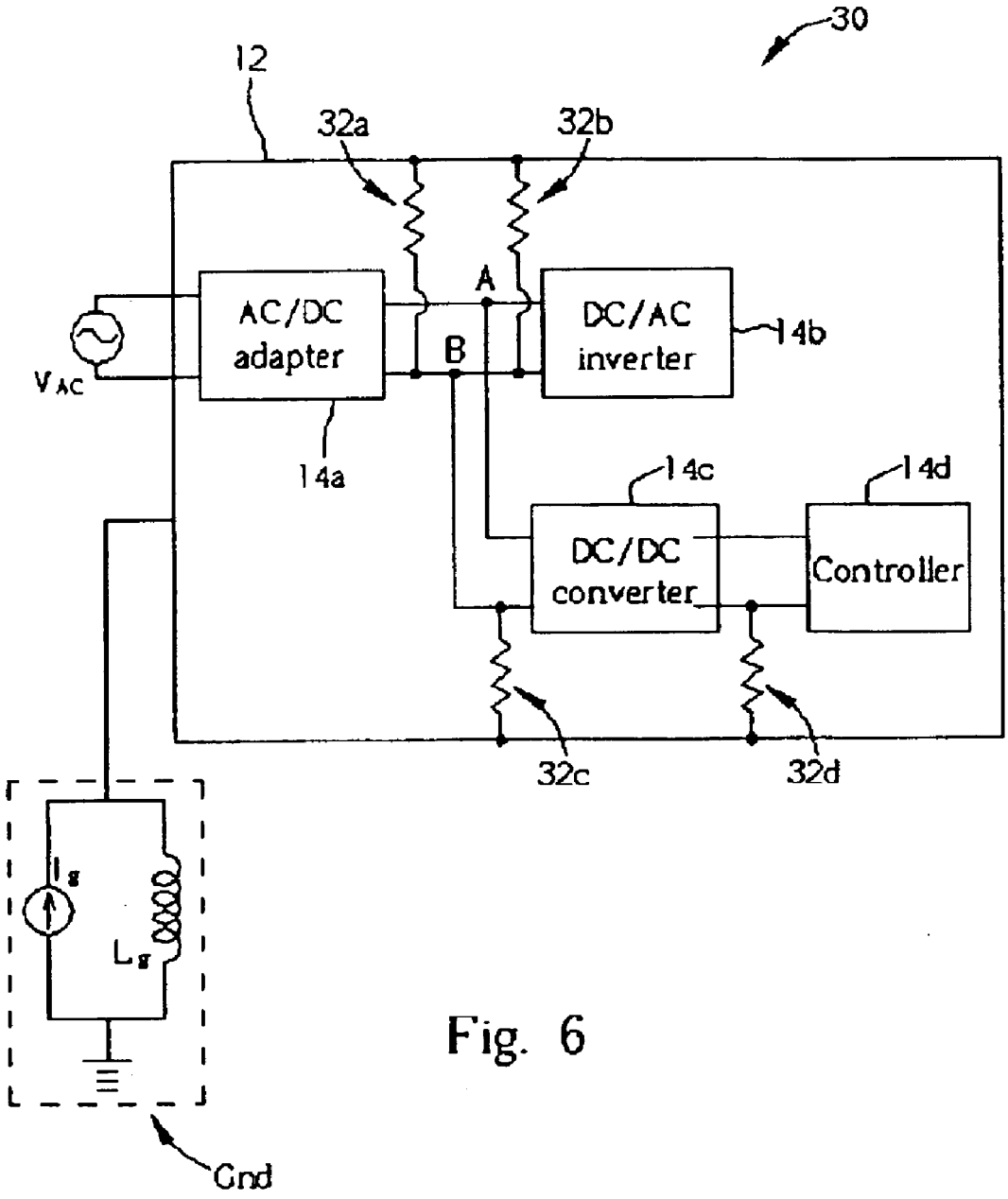
FIG. 6 is the second embodiment of an LCD device according to the present invention.

Please refer to FIG. 6, which is the second embodiment of the LCD device according to the present invention. The LCD device 30 includes a housing 12 and a plurality of circuits 14, both of which are similar to the first embodiment of the LCD device 20. The difference is that the housing 12 is directly connected to a ground terminal Gnd and the LCD device 30 further includes a plurality of filter units each respectively composed of resistors 32*a*, 32*b*, 32*c*, and 32*d*, wherein the reference voltage end of each circuit 14 is electrically connected to the housing 12, i.e. the ground terminal Gnd. Compared to the LCD device 20 shown in FIG. 5, each of the resistor 32*a*, 32*b*, 32*c*, and 32*d* of FIG. 6 respectively coupled with the ground terminal Gnd forms a HPF such that the LCD device 30 is capable of reducing a low-frequency current with a specific frequency flowing from the ground terminal Gnd to the LCD device 30 under the burst dimming mode.

Figure 7:
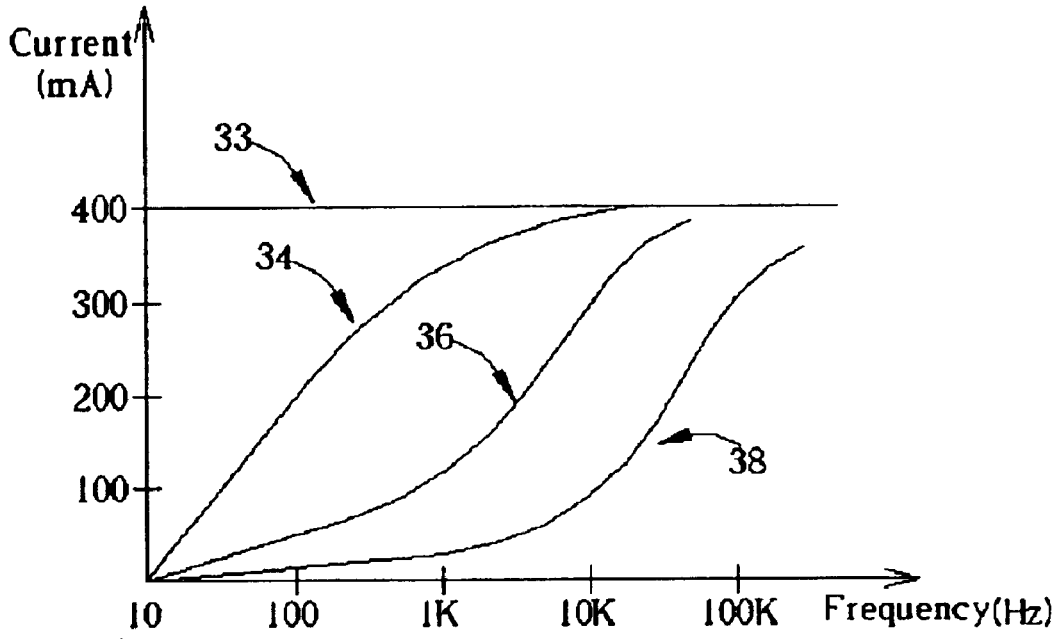
FIG. 7 shows the relationship between the currents flowing from the ground terminal to the LCD device versus frequency according to the first embodiment and the second embodiment.

Please refer to FIG. 7, which shows the relationship between the currents flowing from the ground Gnd to the LCD device 20 versus frequency according to the first embodiment, wherein the horizontal axis represents frequency (Hz) and the vertical axis represents current value (mA). If the inductance of the inductor Lg in the equivalent circuit of the ground terminal Gnd is 30 $\mu$H and the current value of the current source Ig is 400 mA and the resister 22 is not incorporated into the circuit, the ground current-frequency characteristic is illustrated by a characteristic curve 33. If the resistance of the resistor 22 is 0.1 Ω, the relationship between the current flowing from the ground terminal Gnd to the LCD device 20 versus frequency is illustrated by a characteristic curve 34. If the resistance of the resistor 22 is 1 Ω, the relationship between the current flowing from the ground terminal Gnd to the LCD device 20 versus frequency is illustrated by a characteristic curve 36. If the resistance of the resistor 22 is 10 Ω, the relationship between the current flowing from the ground terminal Gnd to the LCD device 20 versus frequency is illustrated by a characteristic curve 38. Accordingly, if the current Ia used to drive the LCD device 20 is adjusted as the frequency stands at 100 Hz, as shown in FIG. 7, the ground current can be greatly reduced through the use the resistor 22 having a larger resistance, which prevents the ground current Ig at the ground terminal GND from resulting in a ripple interference on the LCD device 20 operating under the burst dimming mode. In this embodiment, the resistor 22 with 1 Ω resistance is able to significantly reduce the ground current flowing from the ground terminal Gnd to the LCD device 20, to be less than 100 mA. In the meantime, the LCD device 20 will not be obviously influenced by the ripple interference.

Figure 4:
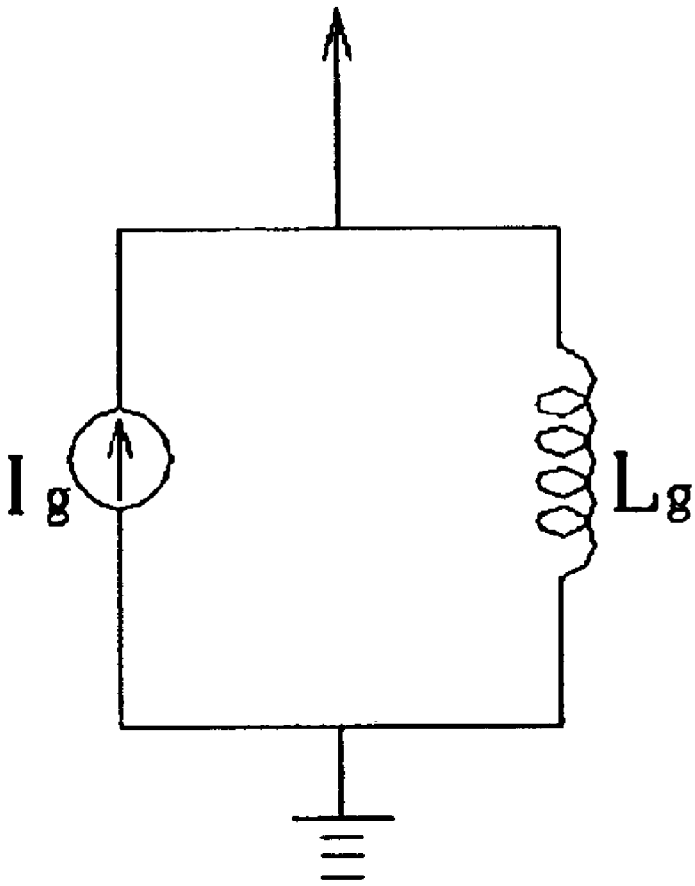
Fig. 4 Prior art
FIG. 4 is an equivalent circuit diagram of ground shown in FIG. 1.
Figure 8:
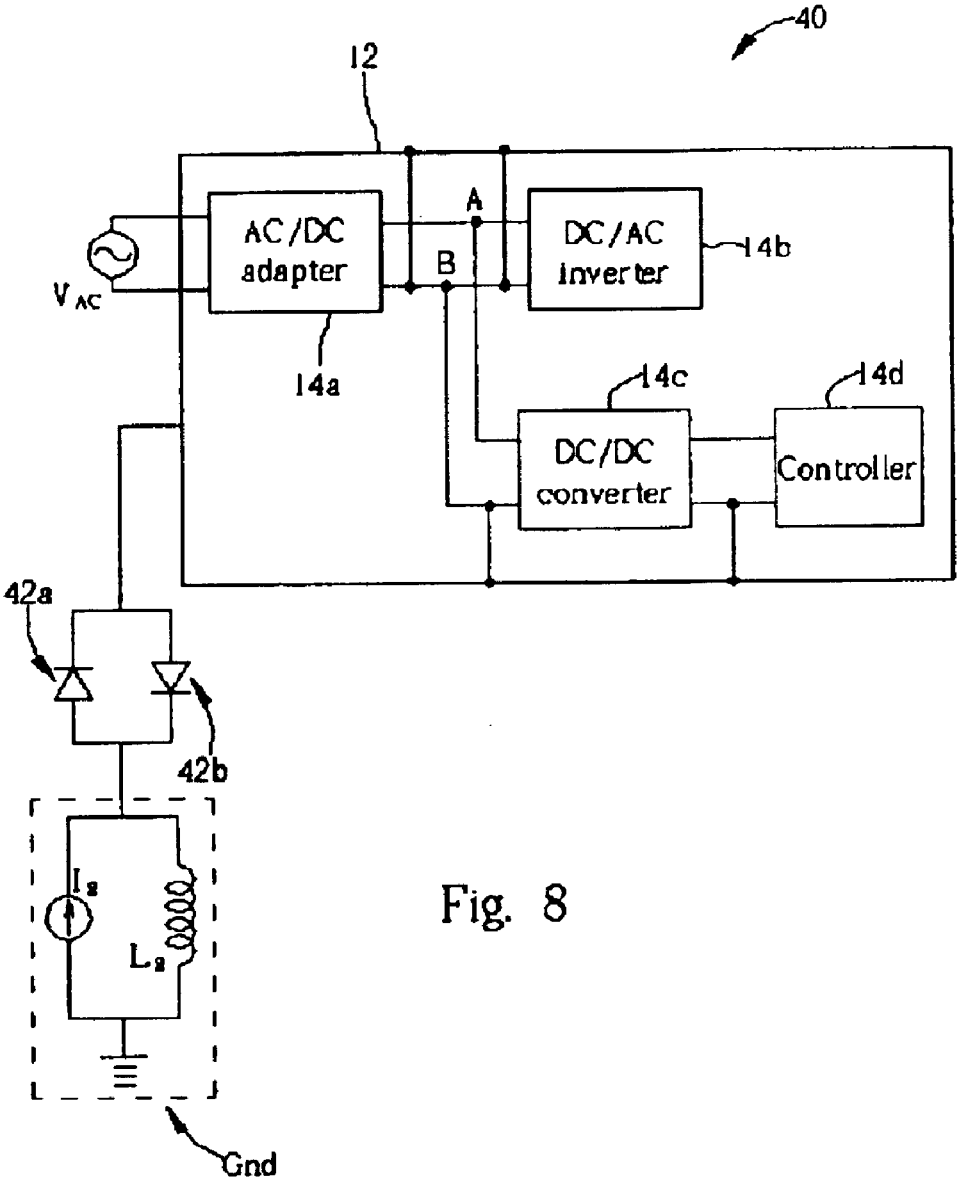
FIG. 8 is the third embodiment of an LCD device according to the present invention.

Please refer to FIG. 5 and FIG. 8. FIG. 8 is the third embodiment of the LCD device 40 according to the present invention. Being different from the LCD device 20, according to this embodiment, diodes 42*a*, 42*b* in the LCD device 40 are used to replace the resistors 22 and serve as a filter unit, where the diodes 42*a* and 42*b* are arranged in parallel with mutually reverse connection polarities, and both are connected between the housing 12 and the ground terminal Gnd. That is, if a voltage difference between the ground terminal Gnd and the housing 12 is a forward bias voltage for the diode 42*a*, such voltage difference is a reverse bias voltage for the diode 42*b*, and vice versa. The housing 12 acting as a conductor is electrically connected to the diodes 42*a*, 42*b* and the reference voltage end of each circuit 14 is electrically connected to the housing 12. That is, the reference voltage end of each circuit 14 is electrically connected to the diodes 42*a* and 42*b*. As shown in FIG. 4, an equivalent circuit electrically connected to the ground terminal Gnd is constructed from a current source Ig connected in parallel with an inductor Lg. A voltage difference between the reference voltage level of the reference end of each circuit 14 and the ground terminal Gnd is extremely small (theoretically, it should be 0). Therefore, the voltage difference is not sufficient to over come the threshold voltages of the diodes 42*a*, 42*b* to turn on any one of the diodes 42*a*, 42*b*. Since the source current Ig is incapable of flowing through the diodes 42*a*, 42*b* to the LCD device 40, the LCD device 40 can prevent a low-frequency current with a specific frequency from flowing from the ground terminal Gnd to the LCD device 40 during the burst dimming mode.

Figure 9:
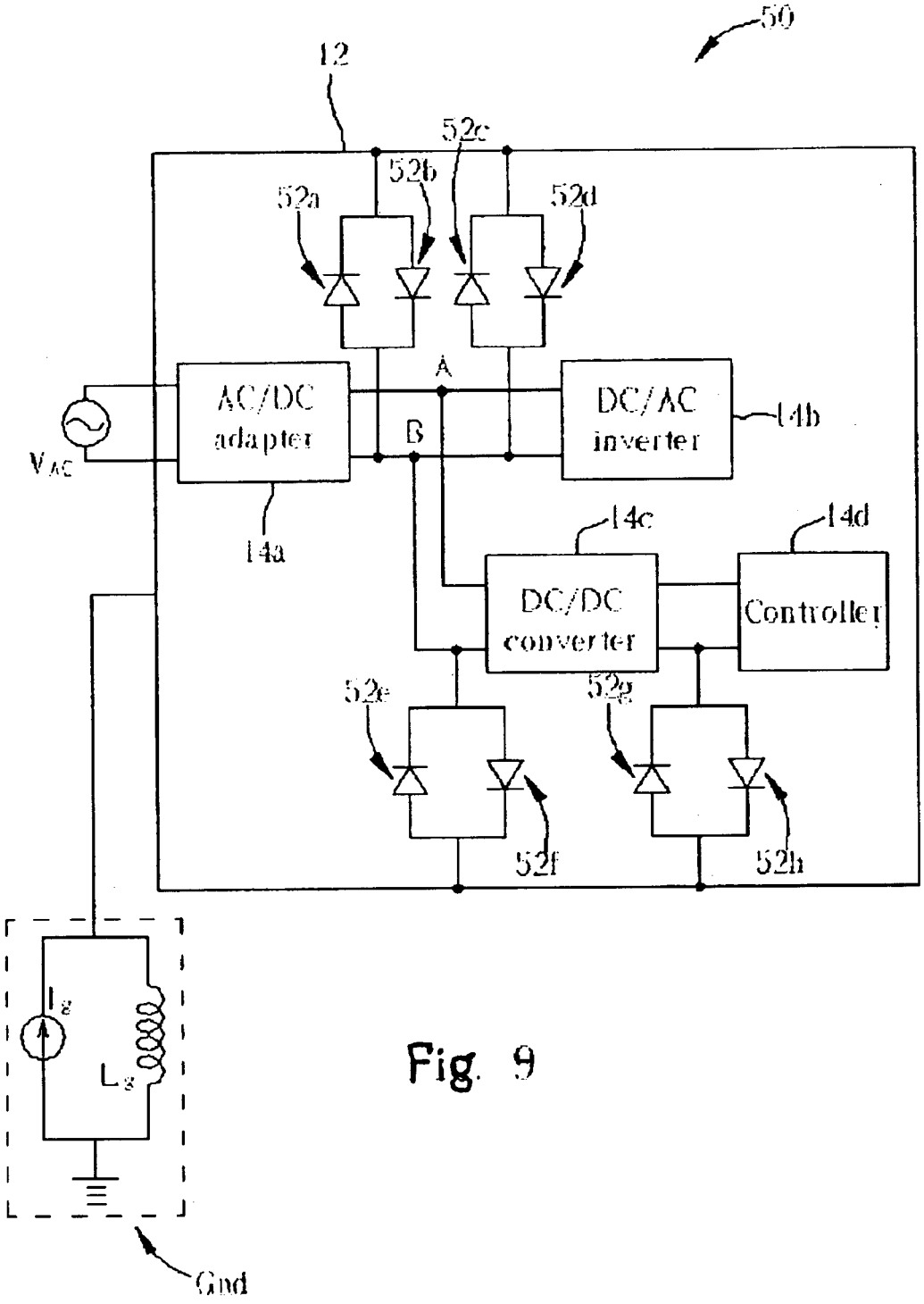
FIG. 9 is the fourth embodiment of an LCD device according to the present invention.

FIG. 9 shows the fourth embodiment of the LCD device 50 according to the present invention, wherein the LCD device 50 shown in FIG. 9 differs from the LCD device 30 shown in FIG. 6 in terms of the use of diodes 52*a*, 52*b*, 52*c*, 52*d*, 52*e*, 52*f*, 52*g*, and 52*h* as filter units for substituting the resistors 32*a*, 32*b*, 32*c*, and 32*d*. The housing 12 is connected to the ground terminal Gnd. The diodes 52*a*, 52*b* are connected in parallel with mutually reverse connection polarities, and both are connected between the reference voltage end of each circuit 14 and the housing 12 (i.e. the ground terminal Gnd). The same situation applies to the diodes 52*c*, 52*d*, the diodes 52*e*, 52*f*, and the diodes 52*g*, 52*h* as well. A voltage difference between the reference voltage level of the reference end of each circuit 14 and the ground terminal Gnd is extremely small, so that the voltage difference fails to overcome the threshold voltage in association with the diodes 52*a*, 52*b*, 52*c*, 52*d*, 52*e*, 52*f*, 52*g*, and 52*h* to turn on any one of the diodes 52*a*, 52*b*, 52*c*, 52*d*, 52*e*, 52*f*, 52*g*, and 52*h*. Since the current source Ig is incapable of flowing through these diodes to the LCD device 50, the LCD device 50 can prevent a low-frequency current with a specific frequency from flowing from the ground terminal Gnd to the LCD device 50 during the burst dimming mode.

Figure 10:
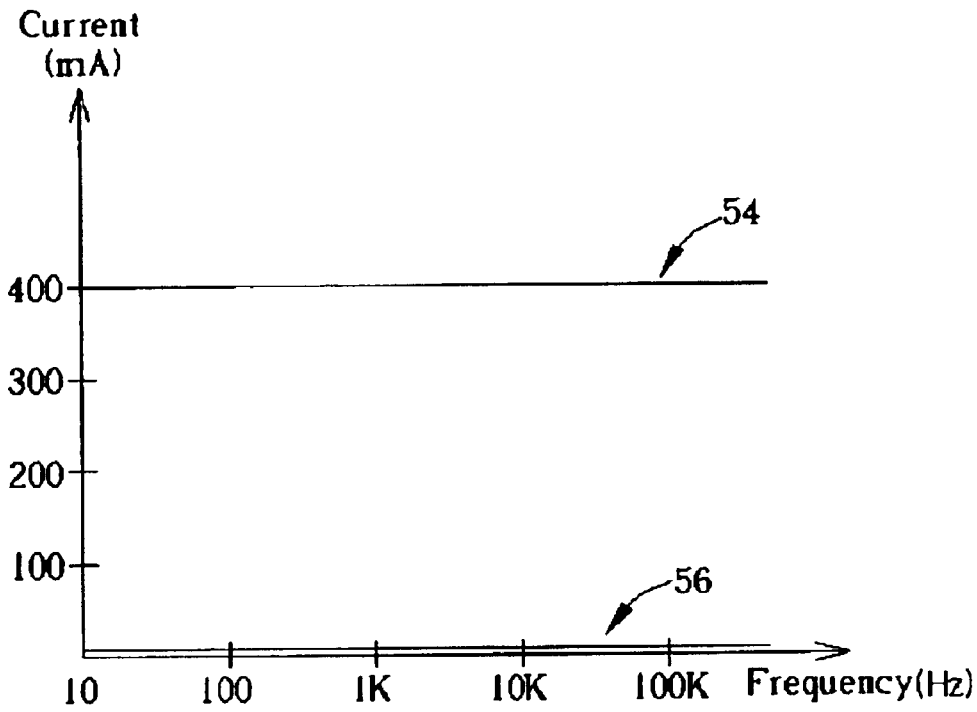
FIG. 10 shows the relationship between currents flowing from the ground terminal to the LCD device versus frequency according to the third embodiment and the fourth embodiment.

Please refer to FIG. 10, which shows the relationship between the currents flowing from the ground terminal Gnd to the LCD device 40, 50 versus frequency, where an inductance of the inductor Lg is 30 $\mu$H and a current value of the current source Ig is 400 mA (characteristic curve 54). Due to an extremely small voltage difference between the reference voltage level corresponding to the reference voltage end of each circuit 14 and the ground terminal Gnd, the diodes are kept off, resulting in a current rating at zero to be inputted to the LCD device 40, 50 (characteristic curve 56). The use of the elementary characteristic of the diode can prevent the ground current Ig from generating the ripple interference on the LCD devices 40, 50 under burst dimming mode.

Figure 11:
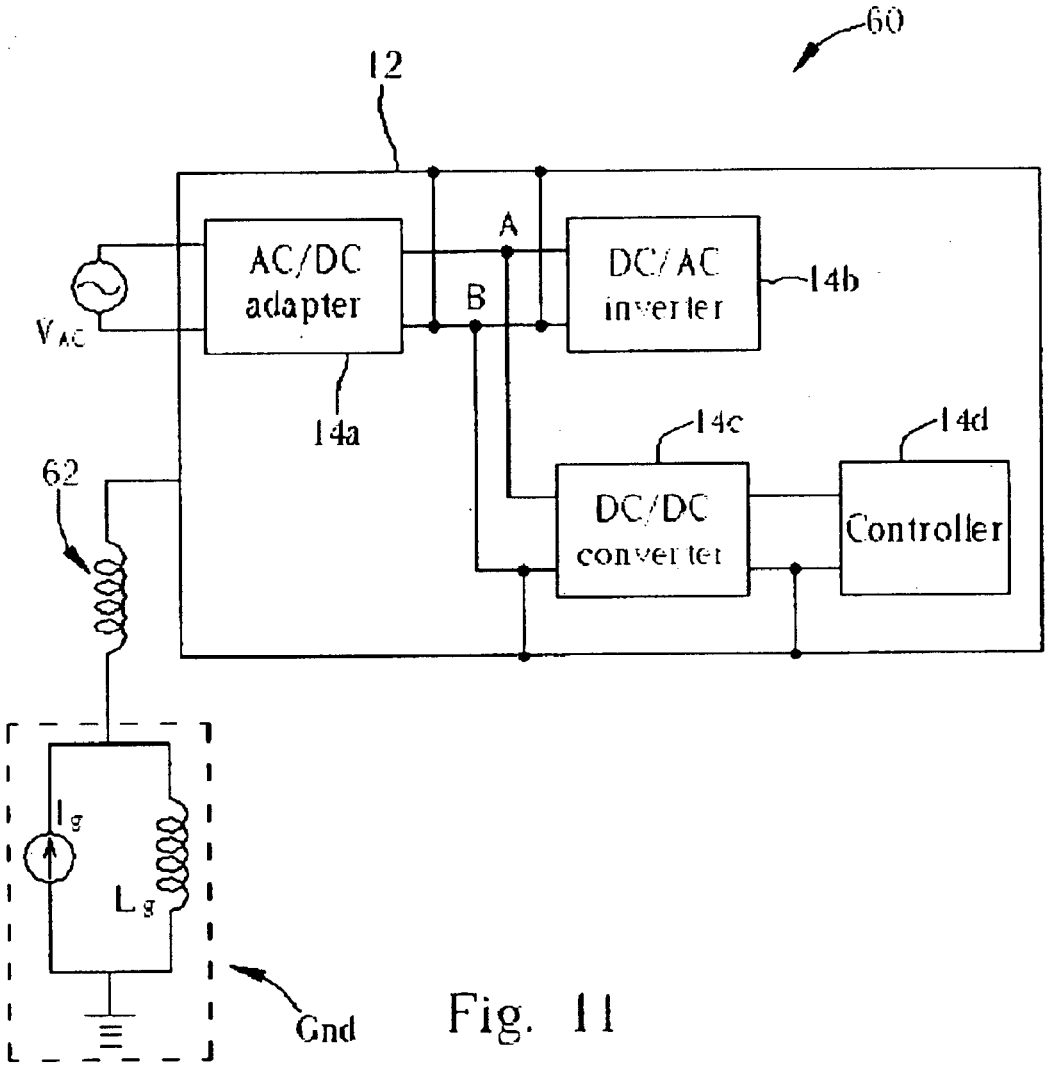
FIG. 11 is the fifth embodiment of an LCD device according to the present invention.

Please refer to FIG. 5 and FIG. 11. FIG. 11 is the fifth embodiment of the LCD device 60 according to the present invention. In this embodiment, the LCD device 60 is different from the LCD device 20 shown in FIG. 5 in that an inductor 62 acting as a filter unit is used to replace the resistors 22 shown in FIG. 5, where the inductor 62 is connected between the ground terminal Gnd and the housing 12. The housing 12, acting as a conductor, is electrically connected to the inductor 62 and the reference voltage end of each circuit 14 is electrically connected to the housing 12. That is, the reference voltage end of each circuit 14 is electrically connected to the inductor 62. As shown in FIG. 4, an equivalent circuit electrically connected to a ground terminal Gnd is constructed from a current source Ig connected in parallel with an inductor Lg. When the inductor 62 connects with the equivalent circuit of the ground terminal Gnd, a relation among an impedance Z, the inductor 62 and the inductor Lg can be represented by the following equation of: $1/Z=1/j\omega L1+1/j\omega L2$ (where L1 represents an inductance of the inductor 62, L2 represents an inductance of the inductor Lg and $\omega$ is an angular frequency of the current Ig flowing through the inductor Lg, 62). Therefore, the inductor 62 and the inductor Lg together form a bypass circuit. While the inductance L1 of the inductor 62 is larger than the inductance L2 of the inductor Lg, an equivalent impedance ($j\omega L1$) in association with the inductor 62 is also larger than an equivalent impedance ($j\omega L2$) in association with the inductor Lg, which leads to a situation that most of the ground current Ig flows to the inductor Lg, i.e. little of the ground current Ig flows to the inductor 62. On the contrary, while the inductance L1 of the inductor 62 is smaller than the inductance L2 of the inductor Lg, an equivalent impedance ($j\omega L1$) in association with the inductor 62 is also smaller than an equivalent impedance ($j\omega L2$) in association with the inductor Lg, which leads to a situation that most of the ground current Ig flows to the inductor 62, i.e. little of the ground current Ig flows to the inductor Lg. In this way, the inductor 62 with an inductance L1 greater than an inductance L2 of the inductor Lg can be utilized to reduce the ground current flowing through the inductor 62 to the LCD device 60, that is, the inductor 62 can reduce a low-frequency current with a specific frequency flowing from the ground terminal Gnd to the LCD device 60 when the LCD device 60 is operating under a burst dimming mode.

Figure 12:
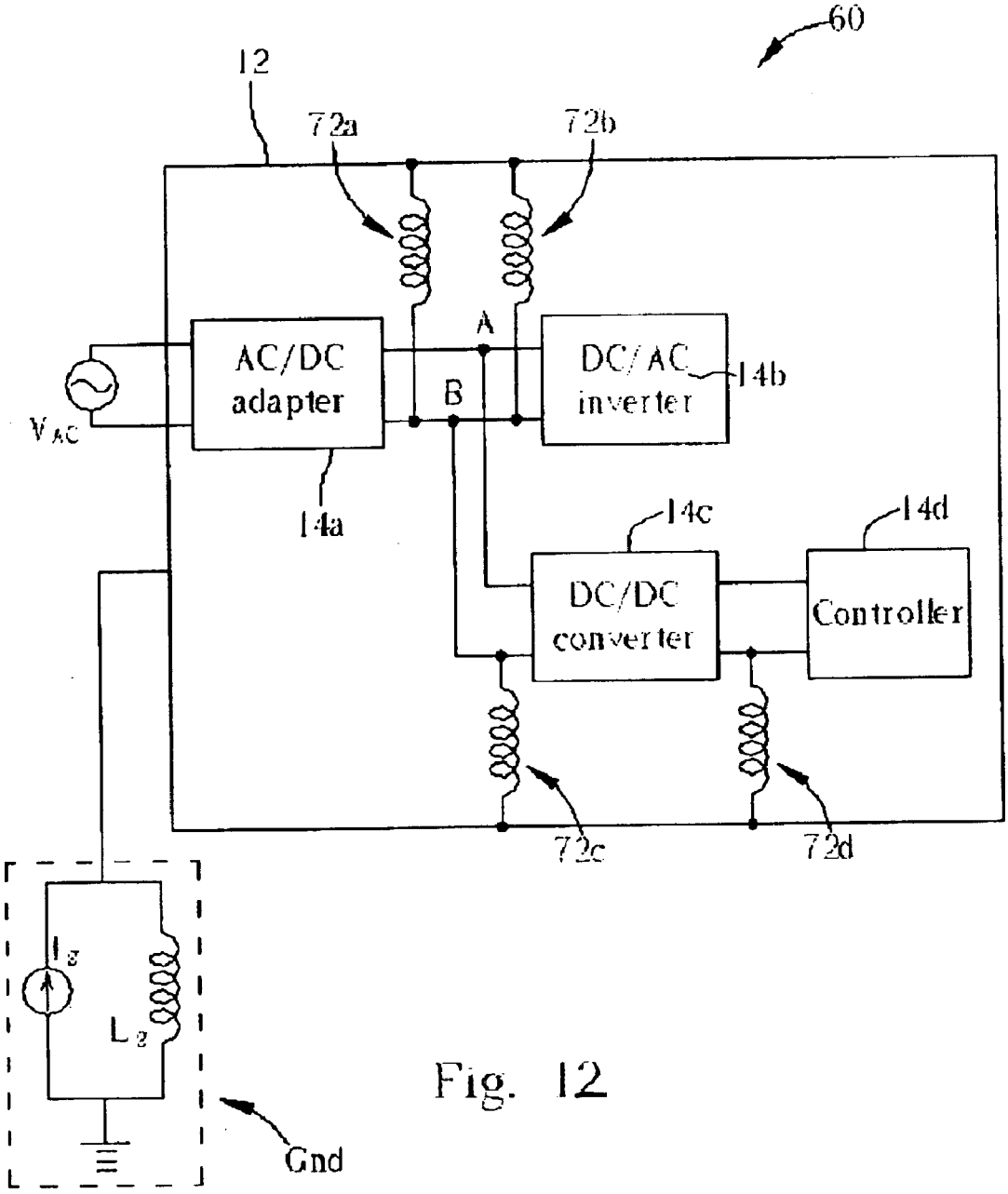
FIG. 12 is the sixth embodiment of an LCD device according to the present invention.

Please refer to FIG. 12, which is the sixth embodiment of the LCD device 70 according to the present invention. Being different from the LCD device 30, according to this embodiment the resistors 32*a*, 32*b*, 32*c*, and 32*d* used in the LCD 70 shown in FIG. 6 are replaced by inductors 72*a*, 72*b*, 72*c*, and 72*d* acting as filter units in the LCD device 70. The housing 12 is connected to a ground terminal Gnd and the inductors 72*a*, 72*b*, 72*c*, and 72*d* are connected between the reference voltage end of each circuit 14 and the housing 12 (i.e. the ground terminal Gnd). As shown in FIG. 12, the inductors 72*a*, 72*b*, 72*c*, 72*d* respectively formed a bypass circuit coupled with the inductor Lg of the ground terminal Gnd. As a result, the LCD device 70 can prevent a low-frequency current with a specific frequency from flowing from the ground terminal Gnd to the LCD device 70 operating under the burst dimming mode.

Figure 13:
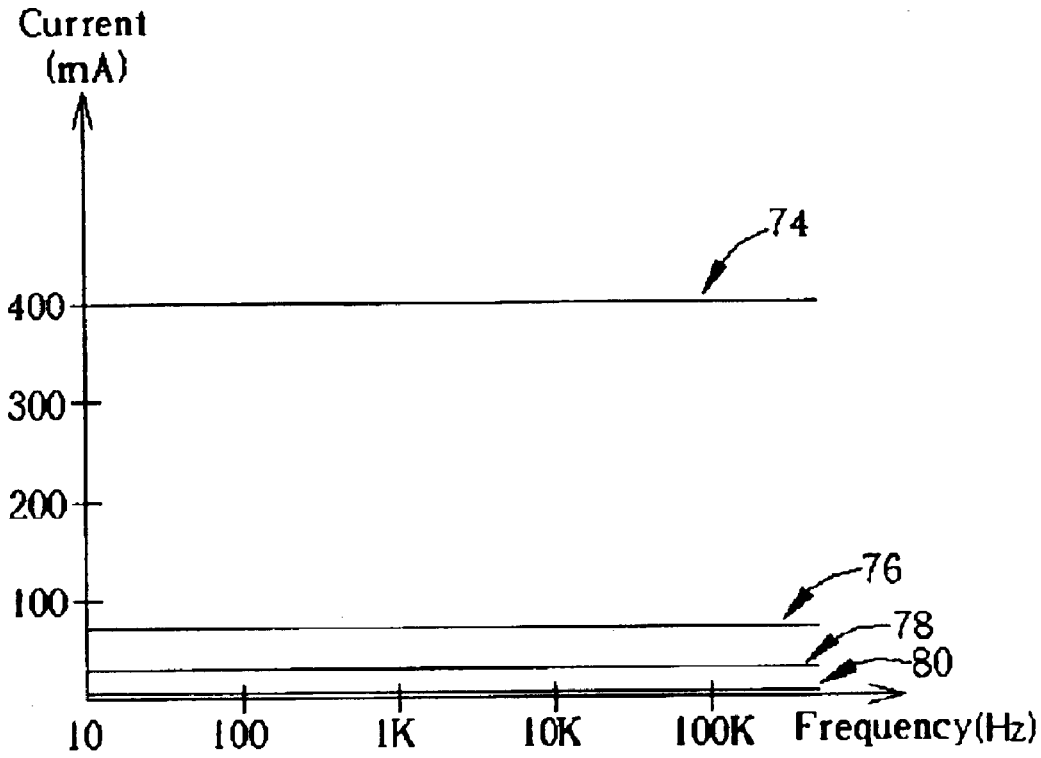
FIG. 13 shows the relationship between currents flowing from the ground terminal to the LCD device versus frequency according to the fifth embodiment and the sixth embodiment.

Please refer to FIG. 13, which shows the relationship between currents flowing from the ground terminal Gnd to the LCD device 60 and frequency according to the fifth embodiment. If the equivalent circuit of the ground terminal GND where the inductor Lg is 30 $\mu$H and the current source Ig is 400 mA (characteristic curve 74) is connected to the inductor 62 having an inductance of 0.2 mH, the relationship between the inputted current from the ground terminal Gnd to the LCD device 60 and the frequency is illustrated by a characteristic curve 76. If the equivalent circuit of the ground terminal GND is connected to the inductor 62 having an inductance of 0.6 mH, the relationship between the inputted current from the ground terminal Gnd to the LCD device 60 and the frequency is illustrated by a characteristic curve 78. If the equivalent circuit of the ground terminal GND is connected to the inductor 62 having an inductance of 1 mH, the relationship between the inputted current from the ground terminal Gnd to the LCD device 60 and the frequency is illustrated by a characteristic curve 80. Accordingly, if the current Ia used to drive the LCD device 20 is adjusted as the frequency stands at 100 Hz, as shownin FIG. 13, the ground current can be greatly reduced through the use of the inductor 62 having a larger inductance, which prevents the ground current source Ig at the ground terminal Gnd from resulting in a ripple interference on the LCD device 60 operating under the burst dimming mode. In this embodiment, the inductor 62 with 0.2 mH inductance is able to significantly reduce the inputted current flowing from the ground terminal Gnd to the LCD device 60, to be less than 100 mA. In the meantime, the LCD device 60 will not be obviously influenced by the ripple interference.

It is beyond doubt that, in the LCD devices 20, 40, and 60 according to present invention, the reference voltage end of each circuit 14 is connected to the housing 12 so as to filter the ground current Ig from the ground terminal Gnd by way of the resistor 22, the diodes 42*a*, 42*b*, or the inductor 62. If any reference voltage end of each circuit 14 is connected to the ground terminal Gnd instead of the housing 12, the resistor 22, the diodes 42*a*, 42*b*, and the inductor 62 are of no use for filtering the ground current that will flow to any other circuit 14. Similarly, in the LCD devices 30, 50, and 70 according to present invention, the reference voltage end of each circuit 14 is connected to the ground terminal Gnd by way of the resistors 32*a*, 32*b*, 32*c*, 32*d*, the diodes 52*a*, 52*b*, 52*c*, 52*d*, 52*e*, 52*e*, 52*f*, 52*g*, 52*h*, and the inductors 72*a*, 72*b*, 72*c*, 72*d* so as to filter the ground current Ig. If any reference voltage end of each circuit 14 is directly connected to ground Gnd (i.e. the housing 12) instead of the above resistors, diodes, or inductors, the resistors 32*a*, 32*b*, 32*c*, 32*d*, the diodes 52*a*, 52*b*, 52*c*, 52*d*, 52*e*, 52*e*, 52*f*, 52*g*, 52*h*, and the inductors 72*a*, 72*b*, 72*c*, 72*d* are of no use for filtering the ground current. As far as all the circuits of present invention are concerned, each reference voltage end connected to a reference voltage level (such as the ground terminal Gnd) has to be connected to the ground terminal Gnd by way of the above filters (resistors, diodes, inductors). Furthermore, various filter units are feasible for the LCD device to filter or reduce the ground current. For example, the resistor 32*a* or 32*b* of the LCD device 30 shown in FIG. 6 can be replaced by an inductor or diodes connected with mutually reverse connection polarities. This would also be encompassed within the scope of the present invention.

In contrast to prior art, during the burst mode dimming operation, the LCD device of the present invention can efficiently reduce or filter the ground current flowing from a ground terminal to the flat panel display device through resistors, diodes, or inductors that are electrically connected to ground. Consequently, due to a reduction of the ripple interference generated by the ground current, the present invention has a better display quality during the burst mode dimming operation.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A flat panel display device comprising:

a housing being a conductor;

a plurality of circuits for driving the flat panel display device, each comprising a reference voltage end electrically connected to a reference voltage level, the reference voltage end of each circuit being connected to the housing; and a filter unit electrically connected between a ground terminal and the housing for reducing a ground current.

2. The flat panel display device of claim 1 wherein the flat panel display device is a liquid crystal display (LCD) device.

3. The flat panel display device of claim 1 wherein the filter unit comprises a resistor for coupling with the ground terminal so as to form a high-pass filter (HPF) to reduce a ground current with a specific frequency.

4. The flat panel display device of claim 3 wherein a resistance of the resistor is inversely proportional to a value of a ground current outputted from the filter unit.

5. The flat panel display device of claim 1 wherein the filter unit comprises a diode, and a threshold voltage of the diode is larger than a voltage difference between a voltage level of the ground terminal and the reference voltage level.

6. The flat panel display device of claim 4 wherein the filter unit comprises two diodes, both being connected in parallel with mutually reverse connection polarities between the ground terminal and the housing.

7. The flat panel display device of claim 1 wherein the filter unit comprises an inductor coupled with the ground terminal for bypassing the ground current.

8. The flat panel display device of claim 7 wherein an inductance of the inductor is inversely proportional to a value of a ground current outputted from the filter unit.

9. The flat panel display device of claim 1 wherein the flat panel display device is operating under a burst dimming mode.

10. A flat panel display device comprising:

a housing connected to a ground terminal acting as a conductor;

a plurality of circuits for driving the flat panel display device, each comprising a reference voltage end electrically connected to a reference voltage level; and a plurality of filter units each electrically connected between the ground terminal and the housing for reducing a ground current.

11. The flat panel display device of claim 10 wherein the flat panel display device is a liquid crystal display (LCD) device.

12. The flat panel display device of claim 10 wherein the filter unit comprises a resistor for coupling with the ground terminal so as to form a high-pass filter (HPF) to reduce a ground current with a specific frequency.

13. The flat panel display device of claim 12 wherein a resistance of the resistor is inversely proportional to a value of a ground current outputted from the filter unit.

14. The flat panel display device of claim 10 wherein the filter unit comprises a diode, and a threshold voltage of the diode is larger than a voltage difference between a voltage level of the ground terminal and the reference voltage level.

15. The flat panel display device of claim 10 wherein the filter unit comprises two diodes, both being connected in parallel with mutually reverse connection polarities between the ground terminal and the housing.

16. The flat panel display device of claim 10 wherein the filter unit comprises an inductor coupled with the ground terminal for bypassing the ground current.

17. The flat panel display device of claim 16 wherein an inductance of the inductor is inversely proportional to a value of the ground current outputted from the filter unit.

18. The flat panel display device of claim 10 wherein the flat panel display device is operating under a burst dimming mode.

* * * * *